US008251660B1

(12) United States Patent
Liang

(10) Patent No.: US 8,251,660 B1
(45) Date of Patent: Aug. 28, 2012

(54) TURBINE AIRFOIL WITH NEAR WALL VORTEX COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 318 days.

(21) Appl. No.: 12/605,404

(22) Filed: Oct. 26, 2009

(51) Int. Cl.
*F01D 5/18* (2006.01)

(52) U.S. Cl. ..... 416/96 R; 415/115

(58) Field of Classification Search ..... 415/115, 415/116; 416/96 R, 97 R
See application file for complete search history.

(56) References Cited

U.S. PATENT DOCUMENTS

| | | | | |
|---|---|---|---|---|
| 7,137,781 | B2 * | 11/2006 | Harvey et al. | 416/96 A |
| 7,534,089 | B2 * | 5/2009 | Liang | 416/97 R |
| 7,866,948 | B1 * | 1/2011 | Liang | 416/97 R |
| 2003/0228221 | A1 * | 12/2003 | Bunker et al. | 416/96 R |

* cited by examiner

*Primary Examiner* — Dwayne J White
(74) *Attorney, Agent, or Firm* — John Ryznic

(57) ABSTRACT

A turbine airfoil having walls with radial extending near wall cooled vortex flowing channels to provide for a high cooling effectiveness with a low cooling flow requirement. A thermal skin is bonded over a main spar in which skewed ribs extend from both the spar and the thermal skin to form a vortex flowing path along the radial channels. The vortex flowing radial channels can be single pass radial channels or connected to form a 3-pass serpentine flow circuit with tip holes to discharge the cooling air from the radial channels and cool the blade tip periphery.

10 Claims, 3 Drawing Sheets

TURBINE AIRFOIL WITH NEAR WALL VORTEX COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine airfoil with near wall low flow cooling.

2. Description of the Related Art

Including Information Disclosed Under 37 CFR 1.97 and 1.98

A gas turbine engine includes a turbine with multiple rows or stages of rotor blades and stator vanes each with an airfoil that reacts with a hot gas flow. Rotor blades and stator vanes have different design constraints due to the rotor blades being exposed to large centrifugal forces from rotation while the stator vanes are exposed to bending forces. However, both blades and vanes have airfoils that require cooling in order to withstand the high gas flow temperatures, especially for the first stage airfoils.

In order to increase the turbine efficiency, and therefore the engine efficiency, a higher gas flow temperature is passed into the turbine, referred to as the turbine inlet temperature. However, the highest turbine inlet temperature is limited to the material properties of the turbine, mainly the first stage airfoils, and the amount of cooling that can be produced for these airfoils. Since the pressurized air used for cooling of these airfoils is bled off from the compressor, the cooling air decreases the efficiency of the engine because work is performed to compressor the cooling air and no useful work are extracted from the compressed cooling air. Thus, low flow cooling circuits for airfoils has the advantage that the engine efficiency is increased.

FIGS. 1 and 2 show a prior art rotor blade using near wall radial flow cooling channels in the airfoil main body. This type of airfoil with the radial channels is constructed by means of a mini-core casting process. For the cooling of the airfoil wall, resupply holes and spanwise extending film cooling holes are used with trip strips in the near wall channels to enhance the heat transfer coefficient. with this prior art near wall cooling design, the spanwise and chordwise cooling flow control due to the airfoil external hot gas temperature and pressure variations is difficult to achieve. Also, the single radial flow channel is not the best method of utilizing the cooling air because it produces a low convective cooling effectiveness. However, the manufacturing approach to from this type of near wall radial flow cooling channel is constrained by the mini-core positioning and minimum wall thickness requirement for the molten metal flow during the casting process. Thin wall airfoils work best for near wall cooling which will maintain low metal temperatures. However, thin walls are very difficult to cast using the investment casting process because of the molten metal is of low viscosity and thus does not flow through small spaces and due to the ceramic core shifting as the heavy molten metal makes contact with the core.

BRIEF SUMMARY OF THE INVENTION

It is an object of the present invention to provide for a near wall cooled turbine airfoil with low flow.

It is another object of the present invention to provide for an air cooled turbine airfoil with reduced airfoil metal temperature so that cooling flow requirement is reduced compared to the prior art near wall cooled airfoil.

It is another object of the present invention to provide for an air cooled turbine airfoil with a high $AN^2$ turbine design due to low cooling flow volume and low weight compared to the prior art near wall cooled airfoil.

It is another object of the present invention to provide for an air cooled turbine airfoil improved spanwise and chordwise cooling flow control due to the airfoil external hot gas temperature and pressure variations compared to the prior art near wall cooled airfoil design.

The above objective and more are achieved with the near wall radial flow cooling channels in the airfoil of the present invention in which the airfoil is formed from a spar with a thin thermal skin bonded to the spar to form the airfoil and form the radial near wall cooling channels. The radial channels include an arrangement of skewed ribs extending out from the spar and from the inner sides of the thermal skin to form a vortex flow passage with a low flow for the cooling air. The radial vortex flow channels can be a single radial channel with cooling air discharged at the tip through tip cooling holes, or a three pass serpentine flow circuit formed from three radial flow vortex channels with the third leg or channel discharging the cooling air through tip cooling holes.

the airfoil can be a rotor blade or a stator vane with the radial vortex flow near wall cooling channels and is formed by casting a main support spar having the general outline of the airfoil with the cooling supply cavities and the skewed ribs extending out from the spar surface, and then bonding a thin thermal skin to the outer spar surface to form the airfoil surface of the blade or vane and define the radial cooling channels. The thermal skin also has skewed ribs extend inward to form the vortex channels with the skewed ribs extending out from the spar surface.

DETAILED DESCRIPTION OF THE INVENTION

Figure 1:
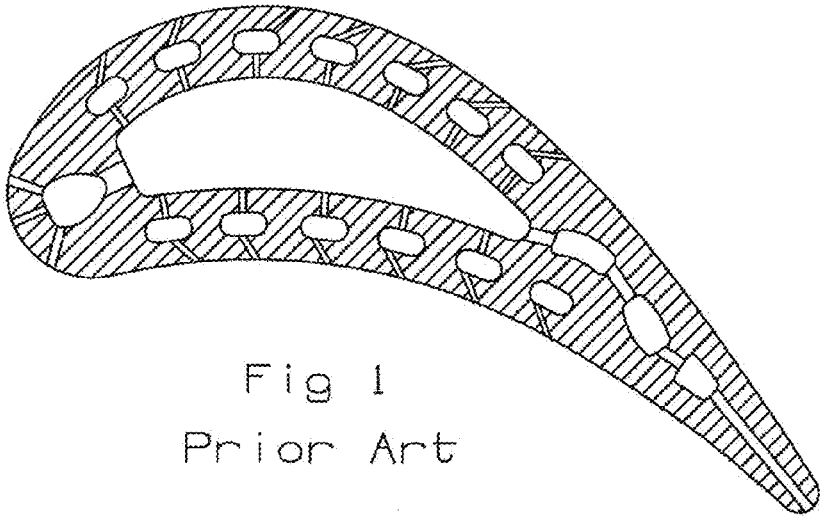
Fig 1 Prior Art
FIG. 1 shows a graph of a cross section top view of a prior art airfoil with radial near wall cooling passages or channels in the airfoil walls.
Figure 2:
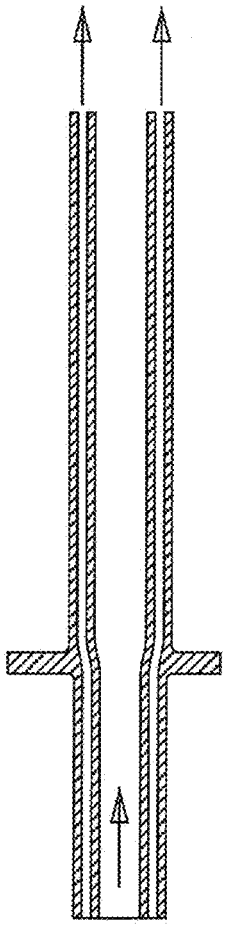
Fig 2 Prior Art
FIG. 2 shows a cross section side view of the prior art airfoil of FIG. 1.
Figure 3:
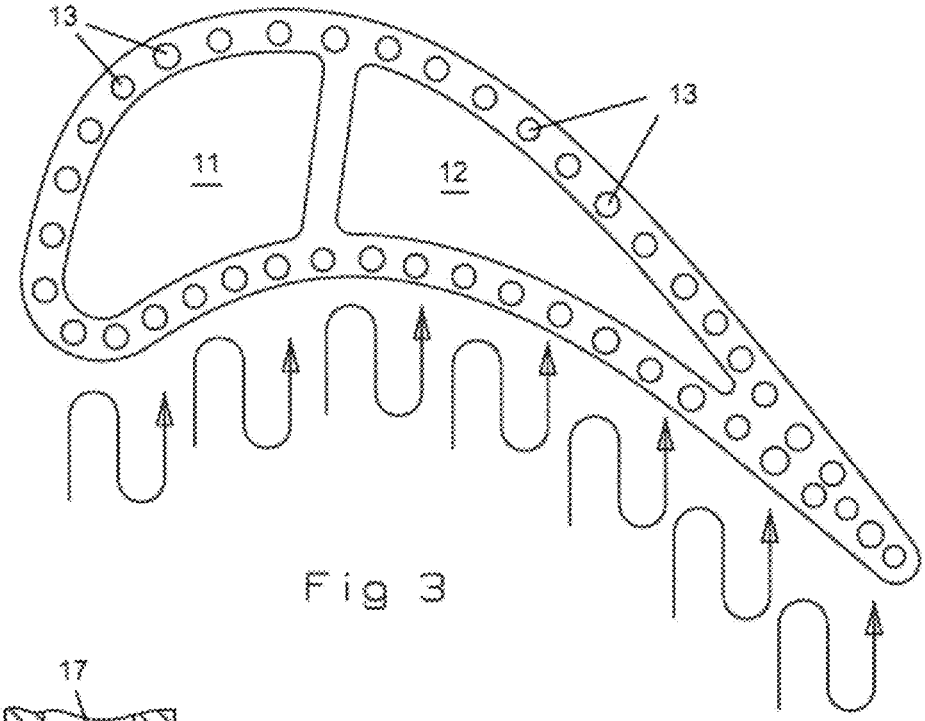
FIG. 3 shows a cross section top view of the radial mini serpentine vortex flow cooling channels of the present invention.

A cross section view of the airfoil with near wall mini vortex flow radial channels 13 is shown in FIG. 3 and includes walls that form the airfoil shape that extend from a leading edge to a trailing edge, and a rib extending across the walls to form two separate a forward cavity 11 from an aft cavity 12. The radial channels 13 are formed between a main spar that forms the support for a thin thermal skin that is bonded to the spar to form the airfoil surface of the blade or vane. As seen in FIG. 3, the radial channels 13 extend around the entire airfoil and into the trailing edge region in which no internal cavity is formed between the pressure side wall and the suction side wall. In one embodiment, the radial channels are single radial channels that each open onto the tip through tip holes to discharge the cooling air from the radial channel and cool the blade tip for the blade embodiment. In another embodiment as seen in FIG. 3 by the diagram, the radial channels form a serpentine flow passage with three channels connected in series.

Figure 4:
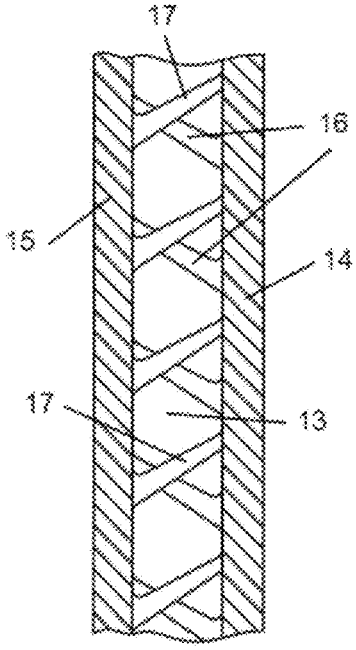
FIG. 4 shows a cross section side view of one of the near wall vortex flow radial channels of the present invention.
Figure 5:
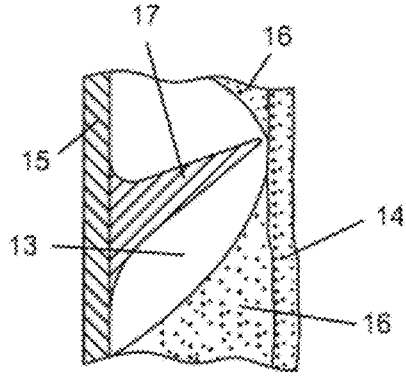
FIG. 5 shows a cross section top view of the near wall vortex flow radial channel of FIG. 4.

FIG. 4 shows the inner wall or spar 14 with skewed ribs 16 extending outward and upward toward the tip end of the airfoil and skewed ribs 17 extending from the outer wall 15 of the airfoil and upward toward the tip end to form a vortex passage along the radial channel 13. FIG. 5 shows a top view of the radial channel of FIG. 4. The skewed ribs 16 and 17 are formed like a constant diameter threaded bolt that is cut in half to form two half moon shaped pieces with a flat back surface and a convex outer surface having the screw threads extending outward from the convex surface and spirally upward. The radial channel 13 would have one of the half moon threaded pieces extending from the wall surface and the other half moon shaped threaded piece would extend form the opposite wall. The threads of the first half moon shaped threaded piece would fit in the grooves formed between the spiral threads of the other half moon shaped threaded piece to form a spirally passage that would produce the vortex flow within the radial channel 13.

Figure 6:
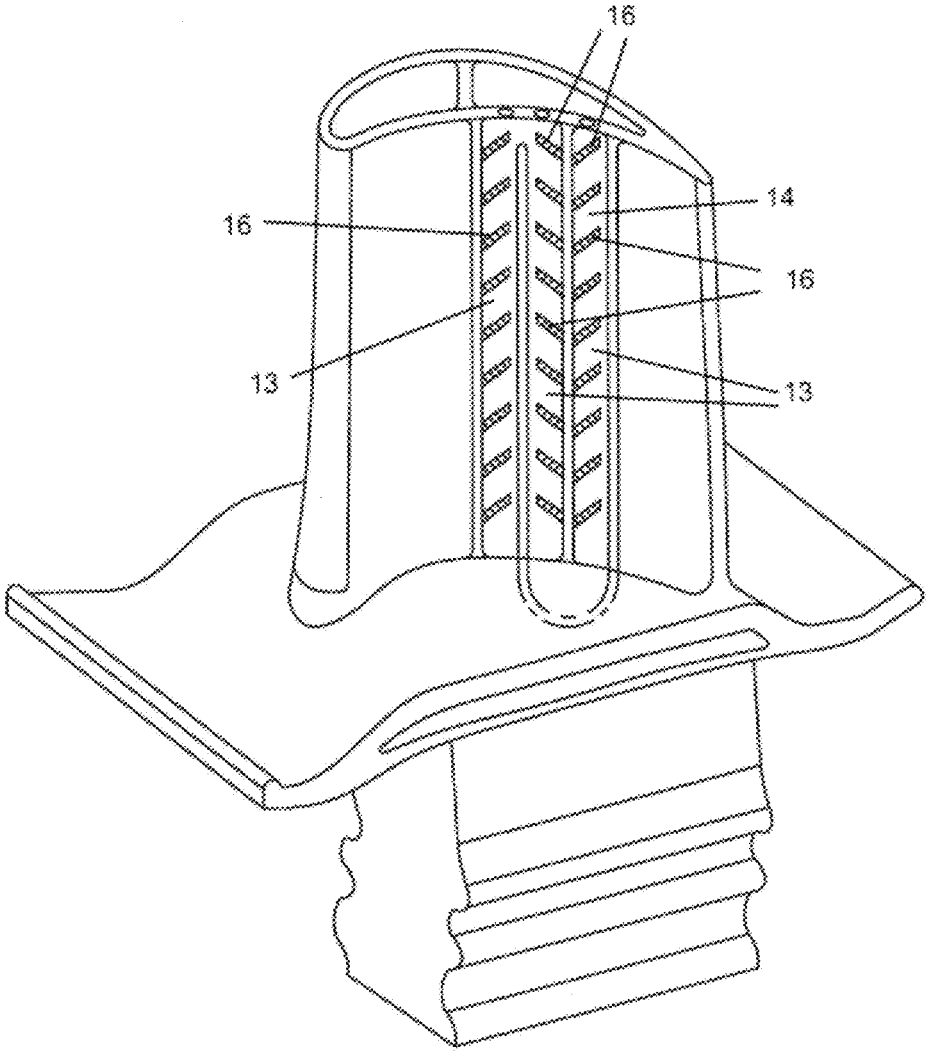
FIG. 6 shows an isometric view of a rotor blade with a cutaway section showing the near wall vortex flow radial channels in the serpentine flow circuit embodiment of the present invention.

FIG. 6 shows an embodiment in which the near wall vortex flow radial channels are used in a rotor blade with a serpentine flow circuit. In FIG. 6, the outer airfoil surface is removed to see into the radial channels with the skewed ribs 16 extending out from the spar or inner wall 16. Radial ribs separate adjacent radial channels 13 to form the 3-pass serpentine flow circuit for this embodiment. Holes that connect the radial channels 13 and open onto the tip or tip rails will discharge cooling air from the radial channels 13 to cool the blade tip. Skewed ribs that extend from the thin thermal skin will form the vortex flow passage to create the vortex flow pattern in the cooling air flowing along the channels 13.

In operation, cooling air is supplied through the airfoil mid-chord cavity below the blade platform. Cooling air is then channeled through each individual mini vortex flow serpentine radial flow channel. Due to the formation of the mini skewed ribs in the opposite wall, the cooling air will flow in a vortex pattern through the radial channel and therefore create a very high heat transfer performance. The mini skewed radial channel can be a single radial channel or a 3-pass serpentine flow passage through three radial channels connected in series. Other serpentine flow passages such as 5-pass or 7-pass can be used but with reduced performance because of the long path for the cooling air to flow. The spent cooling air is discharged at the blade tip periphery through tip cooling holes to provide cooling for the blade tip edges on the pressure side and the suction side walls of the blade.

The thermal skin 15 is bonded to the inner surface or main spar 14 using a transient liquid phase (TLP) bonding process. The blade spar 14 can be cast with the two hollow cavities 11 and 12. Multiple radial flow channels with mini skewed ribs can then be machined or cast onto the surface of the spar 14. The thermal skin 15 can be of a different material than the cast spar 14 or of the same material with the thermal skin bonded onto the spar using TLP bonding. The thermal skin can be formed as a single piece or of multiple pieces in a thin sheet form. The mini skewed ribs extending from the backside of the thermal skin can be formed by photo etching or chemical etching. The thickness of the thermal skin after etching is in the range of 0.010 to 0.030 inches. The mini skewed rib height will be around one half to two thirds of the radial flow channel width. This process of manufacturing the blade will eliminate the constraints for casting of the near wall cooled radial channels that require the use of mini core ceramic molds.

I claim the following:

1. A turbine airfoil for a gas turbine engine comprising:

a main spar having a cross sectional shape of an airfoil with a pressure side wall and a suction side wall, and a leading edge and a trailing edge;

a hollow cavity formed within the main spar;

a thermal skin secured onto the main spar to form an airfoil surface and to form a plurality of radial extending near wall cooling passages;

a first series of skewed ribs extending from the main spar and into the radial extending near wall cooling passage;

a second series of skewed ribs extending from the thermal skin and into the radial extending near wall cooling passage;

the first and second series of skewed ribs both being half-moon shaped pieces that form a spiral flow path; and, the first series of skewed ribs extend into a space formed between the second series of skewed ribs to form a vortex generating flow path for cooling air flowing through the radial extending near wall cooling passages.

2. The turbine airfoil of claim 1, and further comprising:

the turbine airfoil is a rotor blade; and, tip holes are formed along the blade tip and connect the radial extending near wall cooling passages to discharge the cooling air from the radial extending near wall cooling passages.

3. The turbine airfoil of claim 2, and further comprising:

each radial extending near wall cooling passage is a separate radial passage and is connected to a separate tip hole to discharge the cooling air from the radial passage.

4. The turbine airfoil of claim 2, and further comprising:

three radial extending near wall cooling passages are connected in series to form a 3-pass serpentine flow passage for the cooling air.

5. The turbine airfoil of claim 1, and further comprising:

the thermal skin is a thin thermal skin and is secured to the main spar by a transient liquid phase bonding process.

6. The turbine airfoil of claim 1, and further comprising:

a thickness of the thermal skin with the skewed ribs is in a range of 0.010 inches to 0.030 inches.

7. The turbine airfoil of claim 2, and further comprising:

the airfoil is without film cooling holes connected to the radial extending near wall cooling passages to form a low cooling flow blade.

8. The turbine airfoil of claim 1, and further comprising:

the skewed ribs on the main spar and the thermal skin are both shaped like a constant diameter screw cut in half to form two half moon shaped pieces with the convex shaped sides facing each other and with the threads of one piece inserted into a space formed between threads on the opposite piece.

9. A turbine rotor blade comprising:

an airfoil with a wall having a radial extending cooling air passage extending along an entire airfoil spanwise length;

the radial extending cooling air passage having a hot wall surface and a cool wall surface;

a first series of skewed ribs extending from the hot wall surface and into the radial extending cooling air passage;

a second series of skewed ribs extending from the cool wall surface and into the radial extending cooling air passage;

the first and second skewed ribs each having a half-moon shape; and, the first and second series of ribs forming a spiral shaped flow path in which the cooling air flows in a vortex flow.

10. The turbine airfoil of claim 9, and further comprising:

a tip hole are formed along a blade tip and connected to the radial extending cooling air passage to discharge the cooling air from the radial extending cooling air passage.

* * * * *